US005098153A

United States Patent [19]

Antoine

[11] Patent Number: 5,098,153

[45] Date of Patent: Mar. 24, 1992

[54] FOLDING WATERTIGHT OUTSIDE SEAT OF THE BOX-BENCH TYPE

[76] Inventor: Jacques Antoine, 46, Bld. de Montmorency, 75016 Paris, France

[21] Appl. No.: 633,499

[22] Filed: Dec. 26, 1990

Related U.S. Application Data

[63] Continuation-in-part of Ser. No. 289,809, Dec. 27, 1988, abandoned.

[30] Foreign Application Priority Data

Dec. 24, 1987 [FR] France ..... 87 18156

[51] Int. Cl.[5] ..... A47C 13/00

[52] U.S. Cl. ..... 297/17; 297/125

[58] Field of Search ..... 297/125, 124, 123, 17; 289/809

[56] References Cited

U.S. PATENT DOCUMENTS 477,421 6/1892 Jaekel .
732,550 6/1903 Hallstrom .
1,787,245 12/1930 Graham et al. .
2,340,788 2/1944 Aylor .
2,716,775 9/1955 Kenimer .
2,981,313 4/1961 Odell .
3,048,855 8/1962 Frank .

FOREIGN PATENT DOCUMENTS 2550070 2/1985 France .

*Primary Examiner*—Laurie K. Cranmer
*Attorney, Agent, or Firm*—Mason, Fenwick & Lawrence

[57] ABSTRACT

A folding item of furniture of the box-bench type possesses an operating device for a member which is movable in rotation relative to a frame. The movable member comprises a first panel alternately forming the backrest of the bench in the open position and the lid of the box in the closed position, and a second panel, perpendicular to the first, forming a seat part in the open position. A third panel forms the other seat part and is articulated relative to the second. An operating member mounted pivotably on the movable member has an active locking position in which it maintains the movable member in the open position. Three cushions are provided, the first and second cushions being fixed respectively to the first and thirst panels and the third cushion lying on the second cushion so as to be slidable relative thereto. The seat outfitted with cushions can thereby be closed with the cushions stored under the first panel, without the cushions being crushed.

8 Claims, 6 Drawing Sheets

FOLDING WATERTIGHT OUTSIDE SEAT OF THE BOX-BENCH TYPE

CROSS-REFERENCE TO RELATED APPLICATION

This application is a continuation-in-part of U.S. patent application Ser. No. 07/289,809, filed Dec. 27, 1988 now abandoned.

FIELD OF THE INVENTION

The invention relates to a folding outdoor seat of the box-bench type in which a panel forms either, in the open position, the backrest of the bench or, in the closed position, the lid of the box.

Outdoor seats, when they are equipped with cushions, require frequent handling operations since they need to be put under cover when there is a threat of rain and then taken out again when conditions have again become favorable and it is desired to use them. When they ar not equipped with cushions they are rather uncomfortable.

PRIOR ART

The advantages of folding furniture are numerous, and a number of embodiments are already known. In particular, the document FR 2,550,070 describes an operating device for a member which is movable in rotation between two end positions and an item of furniture of the box-bench type which possesses such a device and operation of which is very simple and very reliable.

In this item of furniture, a frame forms the fixed part of the box and a movable member forms either the lid of the box or the backrest and the part forming a seat.

The operating device possesses an operating member having an active locking position, means for maintaining this member in the active position and means for controlling this operating member.

SUMMARY OF THE INVENTION

The object of the invention is to produce an outdoor seat possessing the same advantages which is even more durable, whatever the conditions under which it is used and which, as a bench, can be as comfortable as a non-folding item of furniture. Moreover, it must resist rain without its being necessary to put it under cover nor to remove any element from it.

To this end, what is proposed is a folding item of furniture of the box-bench type possessing an operating device for a member which is movable in rotation relative to a frame, the said movable member comprising a first panel alternately forming the backrest of the bench in the open position and the lid of the box in the closed position, and a second panel, perpendicular to the first, forming a seat part in the open position and possessing a third panel forming the other seat part and articulated relative to the second, and an operating member mounted pivotably on the movable member having an active locking position in which it maintains the movable member in the open position, means for maintaining the operating member in its active locking position and means for controlling the operating member which make it possible to move it away from its active locking position in which, in its active locking position, the operating member limits the movement of the movable piece whatever the direction of the force exerted on its panels.

According to a further feature, the seat according to the invention possesses armrests.

BRIEF DESCRIPTION OF THE DRAWINGS

The invention will be described in detail with reference to the drawings, in which.

DESCRIPTION OF THE PREFERRED EMBODIMENTS

Figure 1:
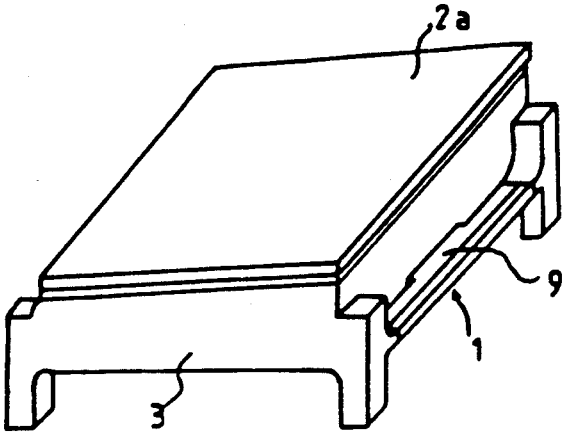
FIG. 1 shows a perspective view of the seat according to the invention in the closed position.
Figure 2:
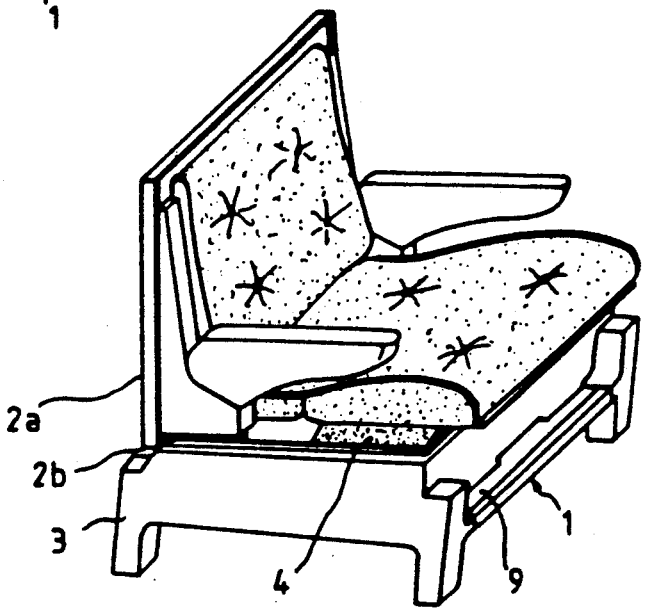
FIG. 2 shows a perspective view of the seat according to the invention in the open position.
Figure 3:
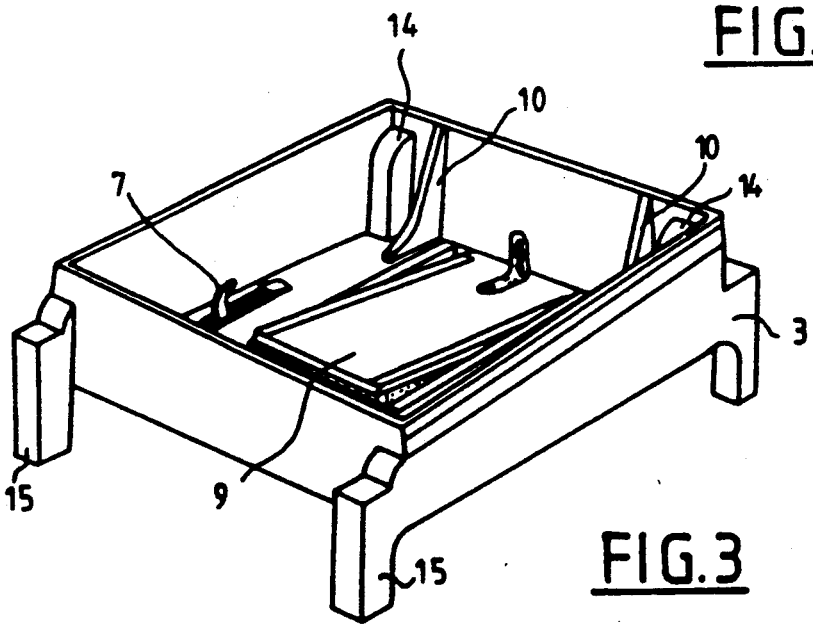
FIG. 3 shows a first perspective view of the frame of the seat according to the invention.
Figure 4:
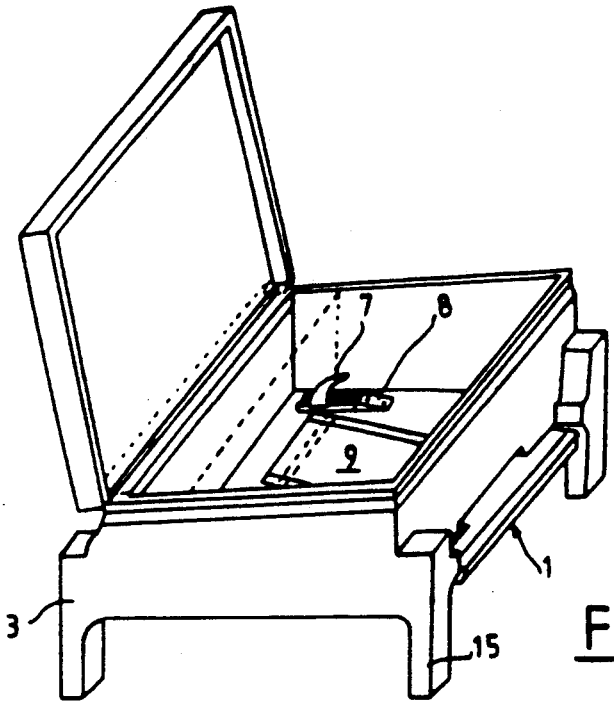
FIG. 4 shows a second perspective view of the frame of the seat according to the invention fitted with the lid of the box.

The seat according to the invention is a folding item of furniture of the box-bench type. It is therefore intended to be able, in the closed position, to form a box as shown in FIG. 1, and in the open position to form an armchair or a bench as shown in FIG. 2.

It possesses an operating device 1 for a member 2 which is movable in rotation relative to a frame 3. This movable member is formed by a first panel **2*a* alternately forming the backrest of the bench in the open position and the lid of the box in the closed position and a second panel 2*b* perpendicular to the first forming a seat part in the open position. It likewise possesses a third panel 4** forming the other part of the seat and articulated relative to the second panel.

The seat possesses an operating member 5 mounted pivotably on the movable member 2 and having an active locking position in which it maintains the movable member 2 in the open position.

It likewise possesses support or locking means 6, 7, 8 for maintaining the operating member in its active locking position and control means 9 for the operating member making it possible to move the latter away from its active position.

Frame 3 is the lower part of the box. It lies on the ground and is supposed not to move.

Member 2 comprises two plane panels **2*a* and 2*b***, fixed one to each other in perpendicular relative positions, so as to have adjacent sides which define an edge.

The member 2 is mounted pivotably to the frame 3. More specifically, member 2 is fixed by its edge to the back upper edge of the frame. This pivotable function of member 2 to frame 3 can be realized by hinges (not shown), each of which have one leaf screwed to member 2 and the other to frame 3. Many other conventional pivotable junctions will be suitable.

Third panel 4 is mounted pivotably to the plane panel 2a. The front edge of panel 2a is connected and articulated to the back edge of the third panel 4.

Operating member 5 is another plane panel. It is mounted pivotably on the movable member 2 along the same joint line as the third panel 4.

Three cushions 17a, 17b, and 17c are provided. First and third cushions 17a and 17c are respectively fixed to first and third panels 2a and 4, and the third cushion 17c lies on second panel 2b.

Figure 8:
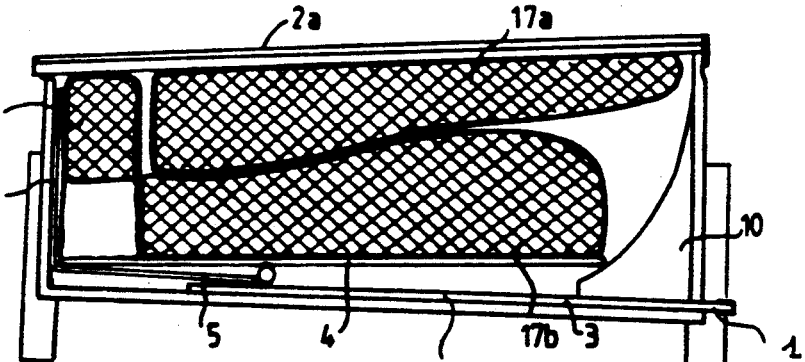
FIG. 8 shows a sectional view of the seat fitted with its cushions in the closed position.

The seat in closed position, forming a closed box is represented in FIG. 8. Panel 2a forms the lid of the box and all the elements of the seat, including cushions 17a, 17b, and 17c, are folded inside the box in the inside space formed by frame 3 and lid 2a. Lid 2a is approximately horizontal in the closed position so that panel 2b is folded close to the back side of frame 3, perpendicular to panel 2a. Third panel 4 lies horizontally on the bottom of the frame 3 and the operating member 5 is folded horizontally between third panel 4 and the bottom of frame 3.

Figure 9:
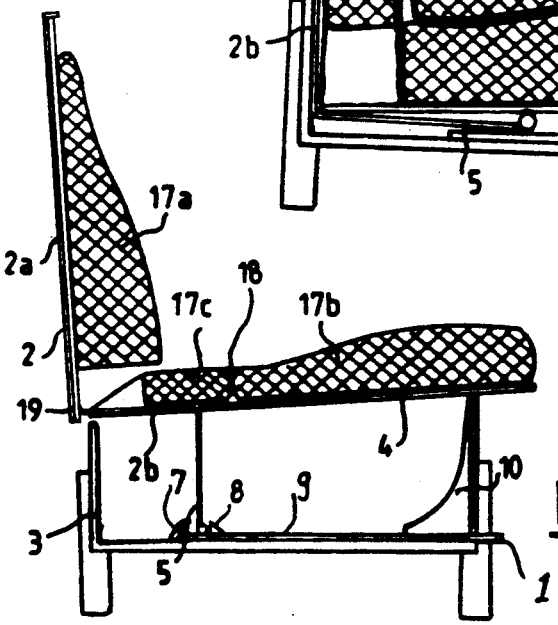
FIG. 9 shows a sectional view of the seat fitted with its cushions in the open position.
Figure 5:
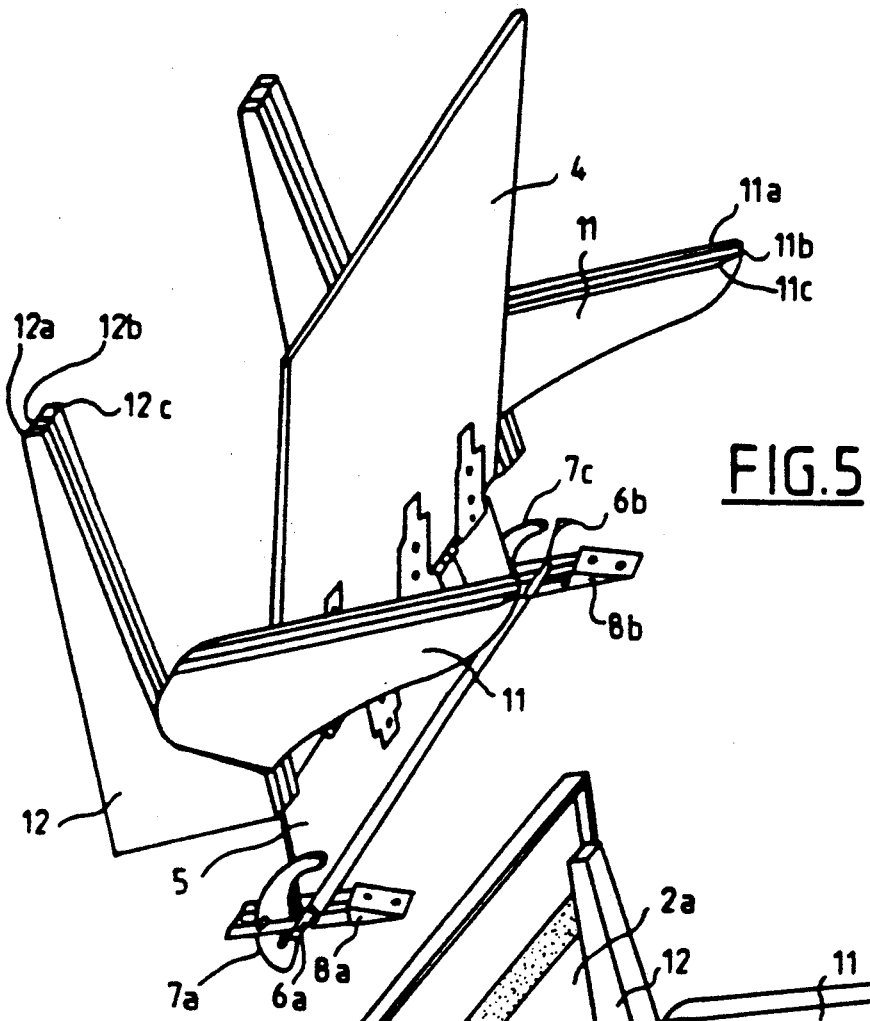
FIG. 5 shows a perspective view of the operating member in the locking position situated relative to the armrests of the seat and relative to a part of the seat.
Figure 6:
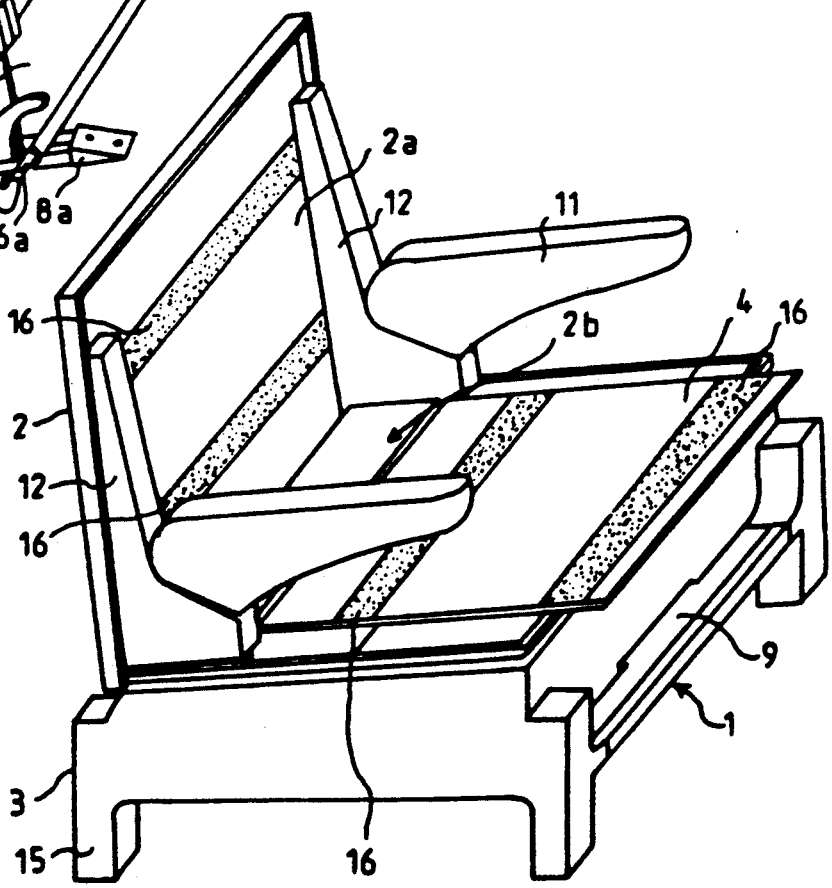
FIG. 6 shows the seat in the open position without its cushions.
Figure 7:
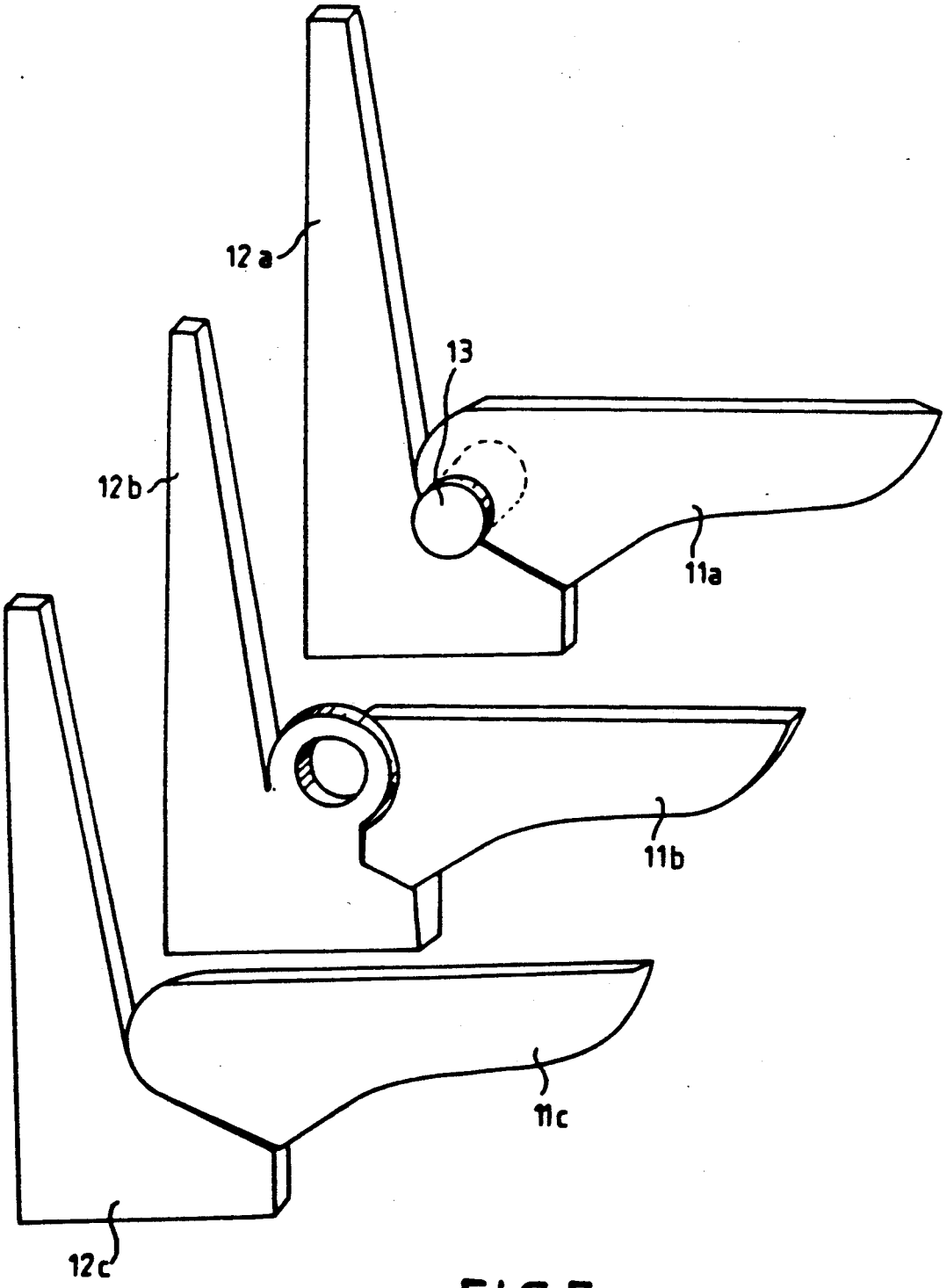
FIG. 7 shows the central part of the armrest of the seat according to the invention.
Figure 10:
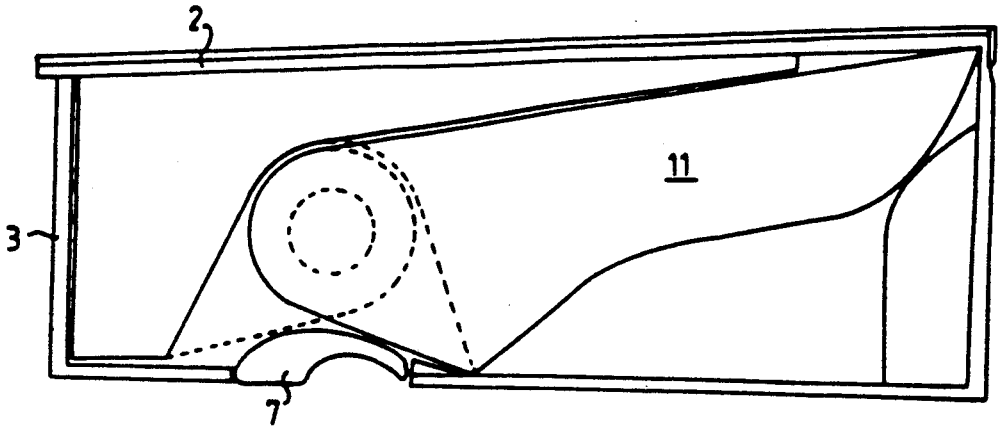
FIG. 10 shows a sectional view of the seat in the closed position, illustrating the position of one of the armrests and one of the keys.
Figure 11:
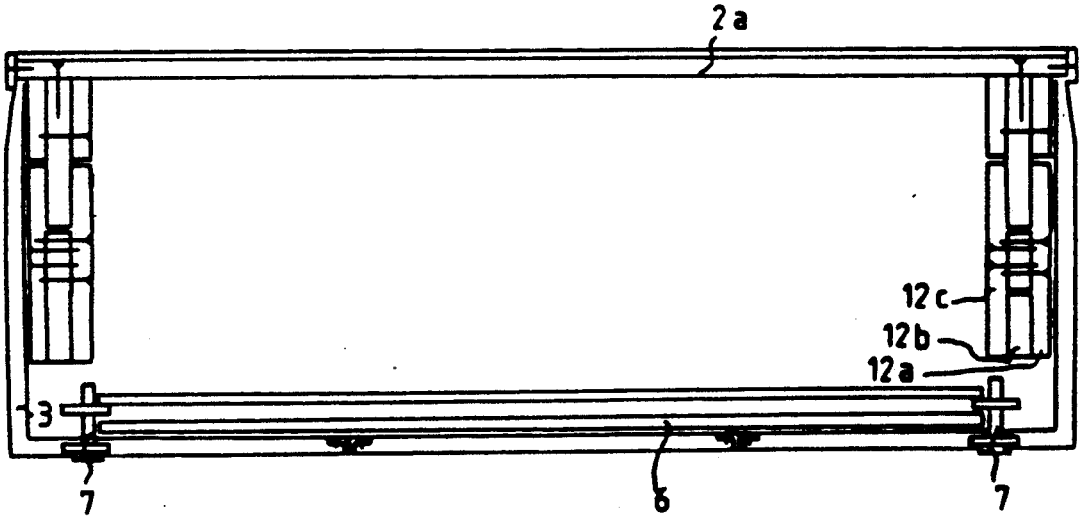
FIG. 11 shows a view in vertical section of the seat according to the invention.
Figure 12:
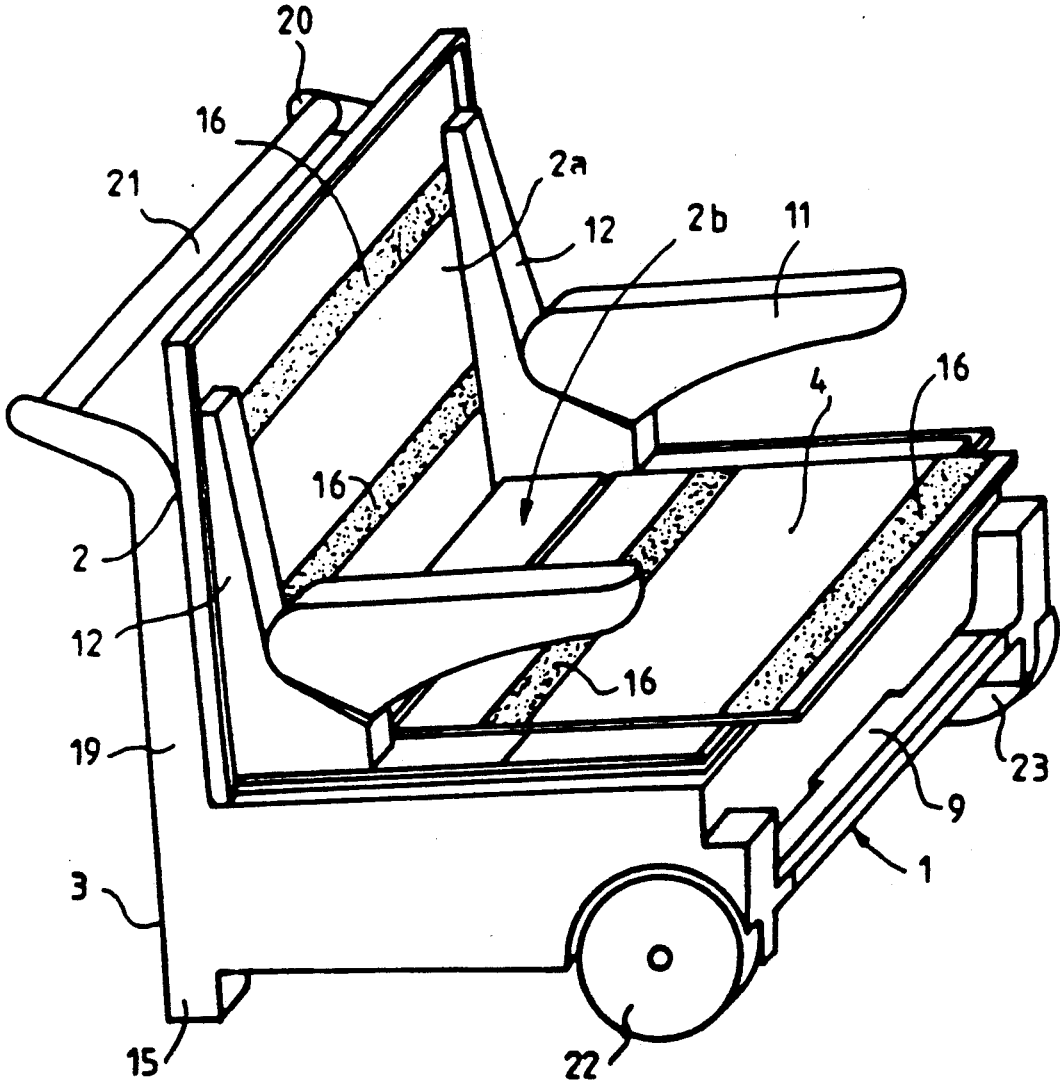
FIG. 12 shows the seat in the open position without its cushions and provided with uprights.

The seat in open position is represented in FIG. 9. In the open position, panel 2a together with cushion 17a form the backrest of the seat and are approximately in a vertical position. So, panel 2b (perpendicular to 2a) is horizontal. Third panel 4 is horizontal and forms a continuation of second panel 2b, both together forming the seat.

The back edge of second panel 2b is pivotably fixed to the back upper edge of frame 3. The front edge of third panel 4 lies on the front upper edge of frame 3.

Operating member 5 is vertical and maintains both the front edge of second panel 2b and the back edge of third panel 4, preventing them from moving down even when someone is sitting.

The seat possesses means limiting the movement of the movable member 2 when a force is exerted on the first panel 2a in the open position, toward the rear. This force may result, for example, from the user leaning on the backrest.

In a first embodiment, the seat possesses two uprights 19, 20 integral with the frame 3 and fixed relative thereto.

In the open position the first panel 2a comes to bear against these uprights which then arrest it in its rearward movement.

Preferably, these uprights 19, 20 are connected at their upper ends by a bar 21. The frame 3 possesses wheels 22, 23. Thus the bar 21 makes it possible to raise the rear of the seat which, then resting on the wheels 22 and 23, can be readily displaced.

In the second embodiment the operating member 5, in its active locking position, limits the movement of the movable member 2 whatever the direction of the force exerted on these panels 2a and 2b.

In the open position, the operating member 5 is maintained in a substantially vertical position. Thus, whatever the force applied downward on any one of the seat parts, the operating member 5 prevents any movement and maintains the backrest and the seat in their positions. When a horizontal force is applied rearward on the backrest 2a, the movement of the operating member 5 being limited, the movement of this backrest 2a is rapidly arrested.

This locking permits a conventional use of the seat. There is no fear of any premature operation of the mechanism when one sits down, and leaning the back against the backrest produces a rocking movement of slight amplitude which is immediately arrested and represents no danger.

In the closed position, shown for example in FIG. 8, the operating member 5 is substantially horizontal and resting on the base of the frame 3; the first panel 2a forms the lid of the box while the panel 2b has come to adopt a vertical position within this box. FIG. 8 is a simplified representation of the relative positions of the operating member 5 and first and second panels 2a and 2b within the frame 3. The manner in which operating member 5 and movable member 2 are pivotally interconnected is shown in FIG. 9.

The operating member 5 possesses two pins 6a and 6b which are substantially cylindrical and each interacts with a key 7 and a stop 8 to limit the movement of the operating member relative to its active locking position. The key prevents its rearward movement and limits the upward movement and the stop 8 prevents the forward movement except when the operating member is raised to a level higher than the latter. The pins 6, the keys 7 and the stops 8 form the locking means for the operating member 5.

Thus starting from the closed position in which the operating member is in a substantially horizontal position when the lid 2a is raised, the operating member tends to rise. At the start of this movement the pins 6 carried by the operating member 5 at the end opposite its axis of articulation with the member 2 are first displaced forward then, at the end of their movement, when the member 5 approaches the vertical position, the pins 6 move from front to back. Sliding on the base of the frame, they are slightly raised by the stops and come to engage in the space defined by the stops 8 and the keys 7. The shape of the key is adapted in a manner such that the movement of the operating member 5 is limited not only rearward but also upward. The stope 8, for their part, limit the forward displacement of the operating member. The seat is thus locked in the open position. Preferably, the key 7 and the stop 8 are fixed to the base of the frame 4 and the key is movable and rocks when the item of furniture is in the closed position. The stop possesses an inclined section oriented upward from front to back, facilitating the movement then the engagement of the pins 6. On the other hand, the rear face of these stops is substantially vertical, in a manner such as to prevent any displacement of the operating member 5 from back to front once it is in the locking position.

The pins 6 are protuberances carried by the operating member. Advantageously, they are formed by a metal rod rigidly fixed to the lower part of this operating plate whose ends extend slightly beyond the sides of the operating plate in a manner such as to form the pins 6.

In other words, safety of this disposal requires that the operating member, precisely the down part of it, may not move during the use of the open seat.

Support means 6, 7, 8 are able to lock the operating member in active position avoiding risk of unwanted folding of the seat.

6a and 6b are two pins rigidly connected to the down edge of the operating member and extending on each side of it. 8a and 8b are two stops rigidly fixed to the bottom of frame 3.

7a and 7b are two keys forming together with stops 8a and 8b two housings in which pins 6a and 6b insert when the lid 2a is unfolded changing the seat from its closed position to the open one. Thus the operating member is locked in open position.

The operating member 5 is mounted pivotably on the movable member 2, and can for example be connected by one or more hinges.

The control means 9 for the operating member 5 simultaneously affect its raising and its forward movement in a manner such as to disengage it from the stop 8. The operating member being thus disengaged, the whole of the movable part of the item of furniture is in an unstable position. The lid 2a tends to close, taking with it the whole of the member 2 and the third panel 4, whose movement is damped by the slides 10. The operating member 5 resumes its horizontal position corresponding to the closed position of the seat.

Preferably, the control means 9 for the operating member 5 comprise an approximately planar plate which is generally parallel to the base of the frame and is articulated about an axis which passes through it parallel to the pivot axis of the operating member 5.

At one of its ends it is placed under the operating member 5 and at its other end it extends over the front of frame 3 (reference number 1).

When the seat is in its open position, we have described above the pins 6 of the operating member are locked between the stops 8 and the keys 7. A voluntary action downwards on the front part of the control means makes an upwards movement of its backparts causing the raising of the operating member that makes him free from the locking means (5, 8) and simultaneously produces its sliding towards the front of the frame. Thus the folding of the seat is allowed, since it is no more prevented by the operating member 5.

When the item of furniture is in the open position a bearing force exerted, for example with the foot, on the outer part of the member 9 causes it to act in the manner of a lever and raise the operating member 5. The angle formed at this time by the control plate 9 and the operating member 5 being obtuse, the latter tends to slide towards the front of the seat, thus producing the movement desired as explained above.

According to a preferred embodiment, the item of furniture according to the invention possesses members 11 which form armrests in the open position and are folded back within the frame in the closed position.

For this purpose, the armrests 11 are fixed to relative to the latter. They are connected to the lid 2a by the member 12. The shape of the member 12 and of the armrests 11 is such that in the open position only an upward rotary movement of the armrests is permitted.

Preferably, the connecting members 12 are produced in three thicknesses 12a, 12b, 12c and the armrests likewise in three thicknesses 11a, 11b, 11c. A shaft 13 then makes it possible to produce the desired rotation while being concealed within these thicknesses.

When the box is closed, the members 11 come to bear on the slides 14 which have, relative to the former, the same function as the slide 10 relative to the third panel 4.

The armrests thus come to lie within the frame at the time of closing. The box, once closed, no longer reveals any moving member or any aperture. It is thus easy to achieve a high-quality seal.

According to a preferred embodiment, the item of furniture according to the invention possesses feet 15 whose dimensions make it possible to fit a plurality of such items one on top of the other within a small space for storage. These feet 15 preferably have the same height as the frame of the box once it is closed. Their upper part is shaped in a manner such as to be able to guide and receive the lower part of the feet of another box.

The item of furniture according to the invention advantageously possesses cushions 17 fixed to the backrest 2a and to the seat parts 2b and 4, and in the closed position the connection of the lid 2a to the frame 4 is leaktight, so that any conventional means can be used to impart the leaktight function. Usually, it will be sufficient that the lid 2a, in its closed position, relies on the upper edge of the frame. The leaktight function can be improved by providing the lid 2a with a lateral border and the frame 3 with an upper edge corporating each with the other in such a way that, in the closed position the lateral border of the lid will recover the upper edge of the frame. Moreover any one of these two elements can be provided with an elastic seal that will improve the leaktight function.

This arrangement is particularly useful and illustrates well the advantages obtained by the system as a whole. Thus, outdoor seats, armchairs, sunloungers and hammock seats can be made really comfortable since they are fitted with upholstery, cushions or padding. It is no longer necessary to take the cushions in as soon as rain threatens and bring them out again when the sun comes out. A single action with one hand makes it possible to open the seat according to the invention, and similarly a single movement of the foot enables these same cushions to be put under cover.

The cushion 17a carried by the backrest and the cushion 17b carried by the third panel 4 are fixed relative to their support during the movements of closing and opening the seat.

By contrast, the third cushion 17c carried by the part of the seat 2b fixed to the backrest is partly free to slide there on. In fact, during the closing movement, starting from the open position, an angle is formed between the seat parts 2b and 4; without a special arrangement, closing would make it necessary to exert a pressure on the backrest in order to obtain and maintain complete closing of the box, and would eventually create permanent deformations of the cushions 17b and 17c.

In order to avoid this difficulty, a relative sliding movement of these cushions is envisaged.

The cushion 17b being fixed relative to the part of the seat 4, the cushion 17c is fixed by its upper surface on one side to the upper surface of the cushion 17b, more precisely by the edge 18, and at the back to the seat part 2b. In the open position a free space is provided under the cushion 17a carried by the backrest between the cushion 17c and the backrest 2a.

The cushions can be connected to the backrest or to the seat by detachable fastenings such as, for example "Velcro" fastenings, making it possible for example to use cushions with removable covers which can therefore be washed.

First and second cushions 17a, 17b are respectively fixed to first and third panels 2a and 4. This means that cushions 17a and 17b do not move relative to these panels during folding or unfolding of the seat.

In contrast, the third cushion 17c lies on the second panel 2b, but is free to slide on it. It is attached by flexible bands, for example by a piece of cloth, from its back upper edge to the back edge of the second panel 2b and from it front upper edge to the back upper edge of the second cushion 17*b* (cushion 17*b* being fixed to the third panel 4). This disposal makes the third cushion 17*c* slide during folding and unfolding of the seat.

In the unfolding state or open position represented in FIG. 9, third cushion 17*c* is aligned with the second cushion 17*b*. When closing the seat, the third cushion 17*c* rotates around its front upper edge (common with the back upper edge of the second cushion 17*b*) relatively to second cushion 17*b*. This movement is helped by the effect of the weight strength to the third cushion 17*c* and makes it slide backwards on the second panel 17*b*.

It is to be emphasized here that this movement makes it possible to close the seat outfitted with cushions without crushing the cushions.

What is claimed is:

1. An outdoor folding seat having a closed position in which it forms a box including a lid and an open position in which it forms a bench including a backrest and a seat, comprising:

a frame having a back upper edge and an axis formed by said back upper edge;

a movable member movable in rotation around said axis formed by said upper edge of said frame, said movable member comprising a first panel alternatively forming the backrest of the seat in the open position and the lid of the box in the closed position, a second panel perpendicular to said first panel, said second panel having a back edge and a front edge, and a third panel having a back edge and a front edge, said front edge of said second panel being articulated to said back edge of said third panel;

limiting means for limiting the movement of said movable member when a rearward force is applied on said first panel in the open position;

first, second, and third cushions, said first and second cushions respectively being fixed to said first and third panels, said second cushion having a back upper edge, and said third cushion being movable relative to said second panel, said third cushion having a back upper edge and a front upper edge and being tied by flexible bonds from its back upper edge to said back edge of said second panel and from its front upper edge to said back upper edge of said second cushion, whereby said third cushion is maintained close to said second cushion in the open position and moves backwards to said first panel in the closed position.

2. The seat as claimed in claim 1, further comprising detachable fastening means for respectively connecting said cushions to the backrest or to the seat.

3. The seat as claimed in claim 1, further comprising members forming armrests in the open position and folded back within the frame in the closed position.

4. The seat as claimed in claim 3, further comprising slide means for supporting said armrests in the closed position and for deployment of said armrests during opening.

5. The seat as claimed in claim 1, said frame being provided with feet having dimensions whereby a plurality of items of furniture can be fit one on top the other within a small space for storage.

6. The seat according to claim 1 wherein in the closed position the connection of the lid to the frame is leak-tight.

7. The article of furniture of claim 1, wherein said limiting means comprises:

an operating member pivotably mounted on said movable member, said operating member having a pivot axis and having an active locking position in which it maintains said movable member in said open position and being movable into and away from said active locking position;

key means for preventing rearward movement and limiting upward movement of said operating member; and stop means for preventing forward movement of said operating member except when said operating member is raised to a level higher than said stop means, and wherein said operating member includes two substantially cylindrical pin means for interacting with said key means and said stop means for limiting the movement of said operating member in said active locking position.

8. The article of furniture of claim 1, further comprising first and second armrests, first and second members respectively connecting said first and second armrests to said first panel, and pivot means for rotating said first and second armrests upwardly relative to said first and second members, respectively, when said first panel is in the open position, said first and second armrests and said first and second members being configured to permit only upward rotary motion of said first and second armrests when said first panel is in the open position.

* * * * *